US007374522B2

(12) United States Patent
Arnold

(10) Patent No.: US 7,374,522 B2
(45) Date of Patent: May 20, 2008

(54) EXERCISE DEVICE HAVING A MOVABLE PLATFORM

(75) Inventor: Peter J. Arnold, Snohomish, WA (US)

(73) Assignee: Precor Incorporated, Woodinville, WA (US)

( * ) Notice: Subject to any disclaimer, the term of this patent is extended or adjusted under 35 U.S.C. 154(b) by 24 days.

(21) Appl. No.: 11/193,269

(22) Filed: Jul. 30, 2005

(65) Prior Publication Data

US 2007/0027009 A1 Feb. 1, 2007

(51) Int. Cl.
*A63B 22/16* (2006.01)

(52) U.S. Cl. ..... 482/146; 482/147; 482/34

(58) Field of Classification Search ..... 482/4, 482/146, 34, 147
See application file for complete search history.

(56) References Cited

U.S. PATENT DOCUMENTS

| | | | | | |
|---|---|---|---|---|---|
| 1,585,748 | A | | 5/1926 | Wendelken | |
| 2,573,808 | A | | 11/1951 | Ravoire | 272/57 |
| 2,862,710 | A | | 12/1958 | Lewis | 272/33 |
| 3,461,857 | A | | 8/1969 | Poulin | 128/25 |
| 3,581,739 | A | * | 6/1971 | Brandt et al. | 601/5 |
| 3,582,066 | A | * | 6/1971 | Keryluk | 482/71 |
| 3,612,520 | A | | 10/1971 | Chang et al. | 272/57 |
| 3,731,919 | A | | 5/1973 | Schurch | 272/57 |
| 3,756,595 | A | | 9/1973 | Hague | 272/70 |
| 3,834,693 | A | * | 9/1974 | Poppenberger | 482/71 |
| 3,870,297 | A | * | 3/1975 | Elder | 482/7 |
| 3,911,907 | A | * | 10/1975 | Smith, Jr. | 482/1 |
| 3,912,260 | A | * | 10/1975 | Rice | 482/4 |
| 3,936,047 | A | * | 2/1976 | Brandt et al. | 482/146 |
| 4,126,326 | A | | 11/1978 | Phillips | 280/205 |
| 4,183,521 | A | | 1/1980 | Kroeker | 272/146 |
| 4,289,306 | A | | 9/1981 | Thomas | 272/33 |
| 4,290,601 | A | | 9/1981 | Mittelstadt | 272/146 |
| 4,376,532 | A | * | 3/1983 | Hunstad | 482/71 |
| 4,396,189 | A | | 8/1983 | Jenkins | 272/97 |
| 4,429,869 | A | * | 2/1984 | Eckstein | 482/71 |
| 4,509,743 | A | | 4/1985 | Lie | 272/97 |
| 4,629,181 | A | * | 12/1986 | Krive | 482/71 |
| 4,650,184 | A | * | 3/1987 | Brebner | 482/71 |
| 4,836,538 | A | * | 6/1989 | Rice | 482/147 |
| 4,861,023 | A | | 8/1989 | Wedman | 272/120 |
| 4,880,226 | A | * | 11/1989 | Krantz | 482/71 |
| 4,905,994 | A | * | 3/1990 | Hartz | 482/146 |
| 4,907,796 | A | | 3/1990 | Roel-Rodriguez | 272/97 |
| 4,911,430 | A | | 3/1990 | Flament | 272/97 |
| 4,946,160 | A | | 8/1990 | Bertoletti | 272/97 |
| 4,953,858 | A | | 9/1990 | Zelli | 272/146 |
| 5,062,629 | A | | 11/1991 | Vaughan | 272/97 |
| 5,078,389 | A | * | 1/1992 | Chen | 482/8 |

(Continued)

*Primary Examiner*—Lori Amerson
(74) *Attorney, Agent, or Firm*—Terence P. O'Brien; Paul Schaafsma; Todd A. Rathe

(57) ABSTRACT

In accordance with the principles of the present invention an exercise device is provided that comprises an oscillating platform and a support platform. The oscillating platform is connected to the support platform by a support having a main axis and an oscillating platform axis extending at an angle from the main axis, such that the oscillating platform defines a plane that is non-parallel to a plane defined by the support platform. An oscillating platform stabilizer enables the free angular undulating movement of the oscillating platform. Inertia or momentum of the angular movement of the platform is provided, thereby providing a fluid and continuous change in the angular orientation of the platform.

26 Claims, 11 Drawing Sheets

U.S. PATENT DOCUMENTS 5,112,045 A * 5/1992 Mason et al. ..... 482/9
5,165,389 A 11/1992 Jing-Qi ..... 128/25
5,188,578 A 2/1993 Voigt ..... 482/71
5,336,141 A 8/1994 Vittone ..... 482/51
5,342,266 A * 8/1994 Dailey ..... 482/71
5,399,140 A 3/1995 Klippel ..... 482/146
5,419,747 A 5/1995 Piaget et al. ..... 482/51
5,433,690 A 7/1995 Gilman ..... 482/146
5,484,363 A 1/1996 Creelman et al. ..... 482/71
5,487,711 A 1/1996 Little ..... 482/79
5,536,225 A 7/1996 Neuberg et al. ..... 482/71
5,582,567 A * 12/1996 Chang ..... 482/146
5,584,780 A * 12/1996 Lin ..... 482/51
5,755,651 A * 5/1998 Homyonfer et al. ..... 482/146
5,755,652 A 5/1998 Gardner ..... 482/146
5,792,027 A * 8/1998 Gvoich ..... 482/51
5,813,958 A * 9/1998 Tomita ..... 482/146
5,879,276 A * 3/1999 Miller ..... 482/146
5,906,561 A 5/1999 Lin ..... 482/52
5,941,807 A * 8/1999 Cassidy et al. ..... 482/146
6,176,817 B1 * 1/2001 Carey et al. ..... 482/146
6,319,177 B1 * 11/2001 Levine ..... 482/100
6,558,304 B1 5/2003 Bardon et al. ..... 482/147
6,666,802 B1 * 12/2003 Rasmussen ..... 482/148
6,692,419 B2 2/2004 Chen ..... 482/146
6,695,755 B1 * 2/2004 Huang ..... 482/146
6,767,313 B2 * 7/2004 Sayce ..... 482/71
6,875,159 B2 * 4/2005 Chuang ..... 482/51
6,918,861 B2 * 7/2005 Liao et al. ..... 482/57
7,004,895 B2 * 2/2006 Perry et al. ..... 482/146
7,074,167 B1 * 7/2006 Chen ..... 482/146
2002/0077231 A1 * 6/2002 Dalebout et al. ..... 482/146
2002/0137610 A1 * 9/2002 Broudy et al. ..... 482/147
2003/0199374 A1 * 10/2003 Perry et al. ..... 482/146
2005/0043143 A1 * 2/2005 Chuang ..... 482/51

* cited by examiner

FIG. 22
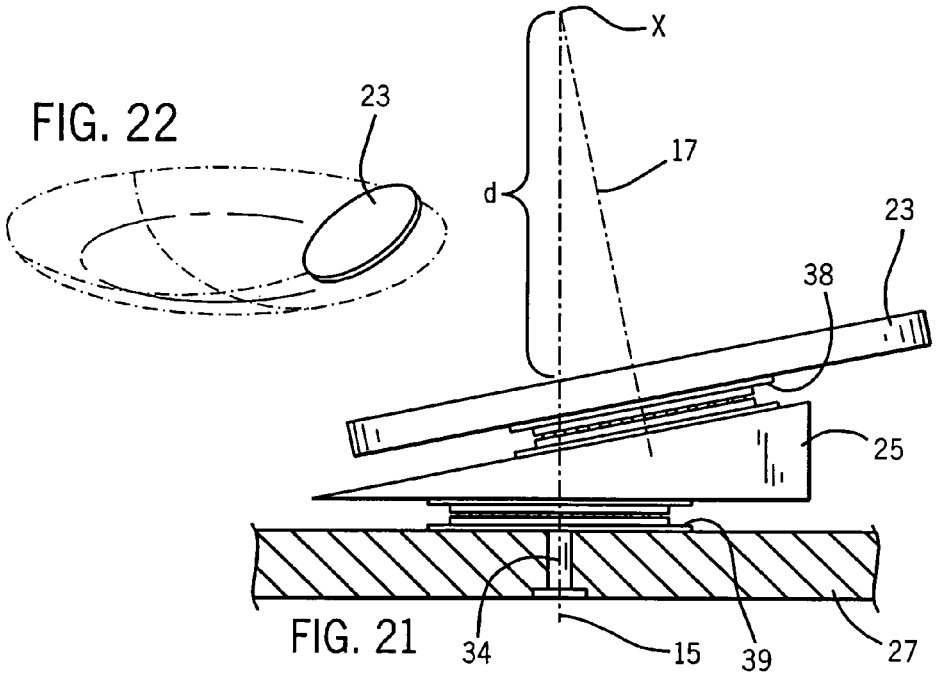
FIG. 21
FIG. 24
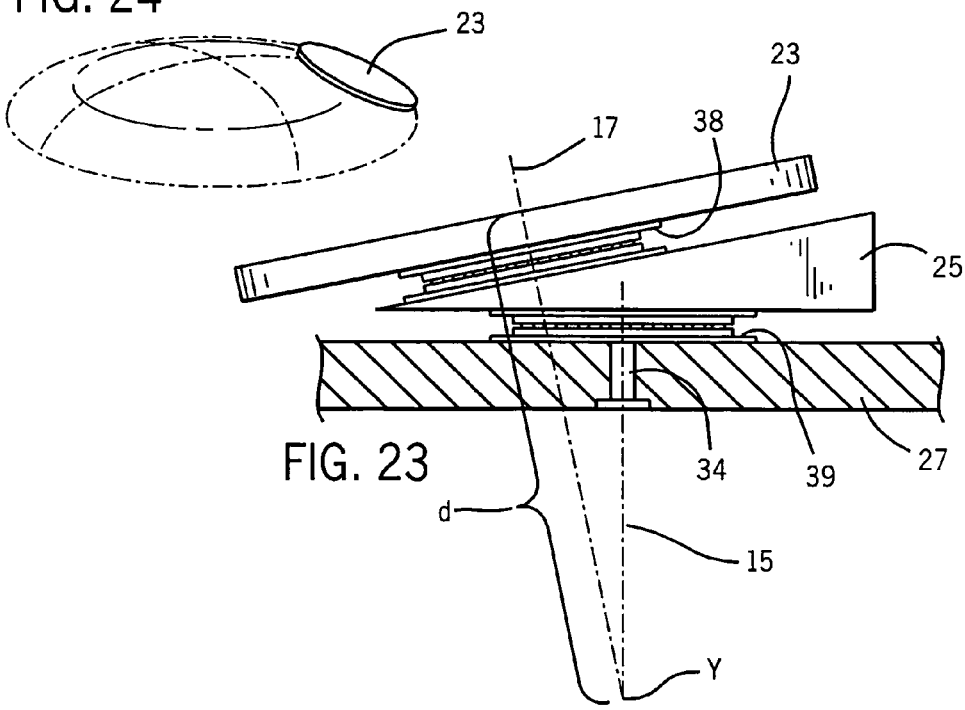
FIG. 23

EXERCISE DEVICE HAVING A MOVABLE PLATFORM

FIELD OF THE INVENTION

The present invention relates to exercise equipment.

BACKGROUND OF THE INVENTION

The benefits of regular exercise have been well established and accepted. However, due to time constraints, inclement weather, and other reasons, many people are prevented from activities such as participating in sports, walking, jogging, running, and swimming. As a result, a variety of exercise equipment has been developed. It is generally desirable to exercise a large number of different muscles so as to provide for balanced physical development, and to achieve optimum levels of exercise. It is further advantageous for exercise equipment to provide smooth and natural motion, thus avoiding significant jarring and strain that can damage both muscles and joints.

While various exercise systems are known in the prior art, these systems suffer from a variety of shortcomings that limit their benefits and/or include unnecessary risks and undesirable features. For example, stationary bicycles are a popular exercise system in the prior art; however, these machines employ a sitting position and require the user's legs to move in a single, fixed, repetitive motion. Cross-country skiing exercise devices are also utilized to simulate the gliding motion of cross-country skiing. While cross-country skiing devices exercise more muscles than stationary bicycles, the substantially flat shuffling foot motion provided by the ski devices limits the range of motion of some of the muscles being exercised.

Treadmills are still a further type of exercise device in the prior art. Treadmills allow natural walking or jogging motions; however, treadmills can enable significant impact loads to be transferred to the hips, knees, ankles, and other joints of the user, particularly when the treadmill is used to simulate running or jogging.

Another type of exercise device simulates stair climbing. Such devices can be composed of foot levers that are pivotally mounted to a frame at their forward ends and have foot-receiving pads at their rearward ends. The user pushes his/her feet down against the foot levers to simulate stair climbing. Resistance to the downward movement of the foot levers is provided by springs, fluid shock absorbers and/or other elements. These devices exercise more muscles than stationary bicycles; however, the rather limited range of up-and-down motion utilized does not exercise the user's leg muscles through a large range of motion. The substantially vertical reciprocating motion of such stair climbing exercise machines can result in substantial impact loads being applied to the hips, knees, ankles and other joints of the user. Further, the up and down reciprocating motion can induce a hyperextension of a user's knee.

A relatively new class of exercise devices is capable of producing elliptical motion that better simulates the natural stride of a person. Elliptical motion is much more natural and analogous to running, jogging, and walking than the linear-type, back and forth motions produced by some prior art exercise equipment. However, these devices that create an elliptical motion are limited to analogizing to running, jogging, and walking motions.

The exercise devices of the prior art largely provide the user with a substantially fixed and limited range of motion that many users' find to be repetitious and uninteresting. It is well known that the more stimulating and enjoyable the experience of exercising is to a user, the longer and more frequently that user will exercise. The very advantage of the exercise equipment described above—the ability to use such equipment conveniently, in a relatively confined space, and in inclement weather—results in exercise devices that are relatively monotonous to use.

Accordingly, a continuing need exists for an exercise device that provides an enjoyable stimulating experience and avoids being relatively monotonous to use. A need exists for an exercise device that enables a user to use his or her own creativity to define the exercise movements. There is also a need for an exercise device that enables the user to exercise muscles in a smooth natural manner, without applying undesirable impact loads to the user's joints. There is also a need for an exercise device that enables a user to improve his or her stability, coordination, rhythm and balance. It would be desirable for such an exercise device to be configured for convenient use in a relatively confined space even in inclement weather.

SUMMARY OF THE INVENTION

An exercise device in accordance with the principles of the present invention provides an enjoyable stimulating experience and avoids being relatively monotonous to use, by enabling a user to employ a large variety of motions and to employ a wide variety of different motions. An exercise device in accordance with the principles of the present invention exercise muscles in a smooth natural manner, without applying undesirable impact loads to the user's joints. An exercise device in accordance with the present invention can be used to exercise and improve a user's stability, coordination, rhythm and/or balance. An exercise device in accordance with the principles of the present invention can be conveniently used in a relatively confined space even in inclement weather.

In accordance with the principles of the present invention an exercise device is provided that comprises an oscillating platform and a support platform. The oscillating platform is connected to the support platform by a support having a main axis and an oscillating platform axis extending at an angle from the main axis, such that the oscillating platform defines a plane that is non-parallel to a plane defined by the support platform. An oscillating platform stabilizer enables the free angular undulating movement of the oscillating platform. Inertia or momentum of the angular movement of the platform is provided, thereby providing a fluid and continuous change in the angular orientation of the platform.

According to a principal aspect of the invention, an exercise device includes a base having a main axis, a movable unit supported by the base, a platform and an upper body support. The platform is operably coupled to the movable unit. The platform defines a second axis that is non-parallel to the main axis. The movable unit is rotatable about at least one of the main axis and the second axis. The platform is configured to support a user. The upper body support is coupled to at least one of the base and the platform.

According to another principal aspect of the invention, an exercise device for at least one user includes a base having a main axis, an intermediate assembly and a platform. The intermediate assembly is supported by the base. The intermediate assembly includes an adjustable unit and a movable unit. The platform is operably coupled to the intermediate assembly and is configured to support the user. The adjustable unit of the intermediate assembly is positionable between at least a first position, wherein the platform generally extends about a first plane defining a first angle with respect to the base, and a second position, wherein the platform generally extends about a second plane defining a second angle with respect to the base. The second angle is greater than the first angle.

According to another principal aspect of the invention, an exercise device for at least one user includes a base having a main axis, an intermediate assembly and a platform. The intermediate assembly is supported by the base. The intermediate assembly includes an adjustable unit and a movable unit. The platform is operably coupled to the intermediate assembly and is configured to support the at least one user. The adjustable unit of the intermediate assembly is positionable between at least a first position, wherein the platform is generally positioned about the main axis, and a second position, wherein the platform is generally positioned about a second axis parallel the main axis. The second axis is a first predetermined distance apart from the main axis.

According to another principal aspect of the invention, an exercise device includes a base defining a first plane, a movable unit supported by the base, a platform and an inertial application assembly. The platform is operably coupled to the movable unit. The platform defines a second plane that is non-parallel to the first plane. The platform is configured to support a user. The inertial application assembly is coupled to the movable unit. The inertial application assembly is configured to vary the inertia of the exercise device during use.

According to yet another principal aspect of the invention, an exercise device for at least one user includes a base having a main axis, a movable unit supported by the base, a platform, and a platform rotating assembly. The platform has an upper surface and a platform axis that extends generally perpendicular from the upper surface. The platform is operably coupled to the movable unit. The platform is configured to support the at least one user. The platform rotating assembly is operably coupled to the platform, and is configured to rotate the platform about the platform axis.

This invention will become more fully understood from the following detailed description, taken in conjunction with the accompanying drawings described herein below, and wherein like reference numerals refer to like parts.

BRIEF DESCRIPTION OF THE DRAWINGS

FIG. 21 is an elevated, partially cut-away side view of an additional embodiment of an exercise device in accordance with the principles of the present invention.

FIG. 22 is a schematic showing a movement of the device of FIG. 21.

FIG. 23 is an elevated, partially cut-away side view of an additional embodiment of an exercise device in accordance with the principles of the present invention.

FIG. 24 is a second schematic showing a movement of the device of FIG. 23.

DETAILED DESCRIPTION OF A PREFERRED EMBODIMENT

Figure 1:
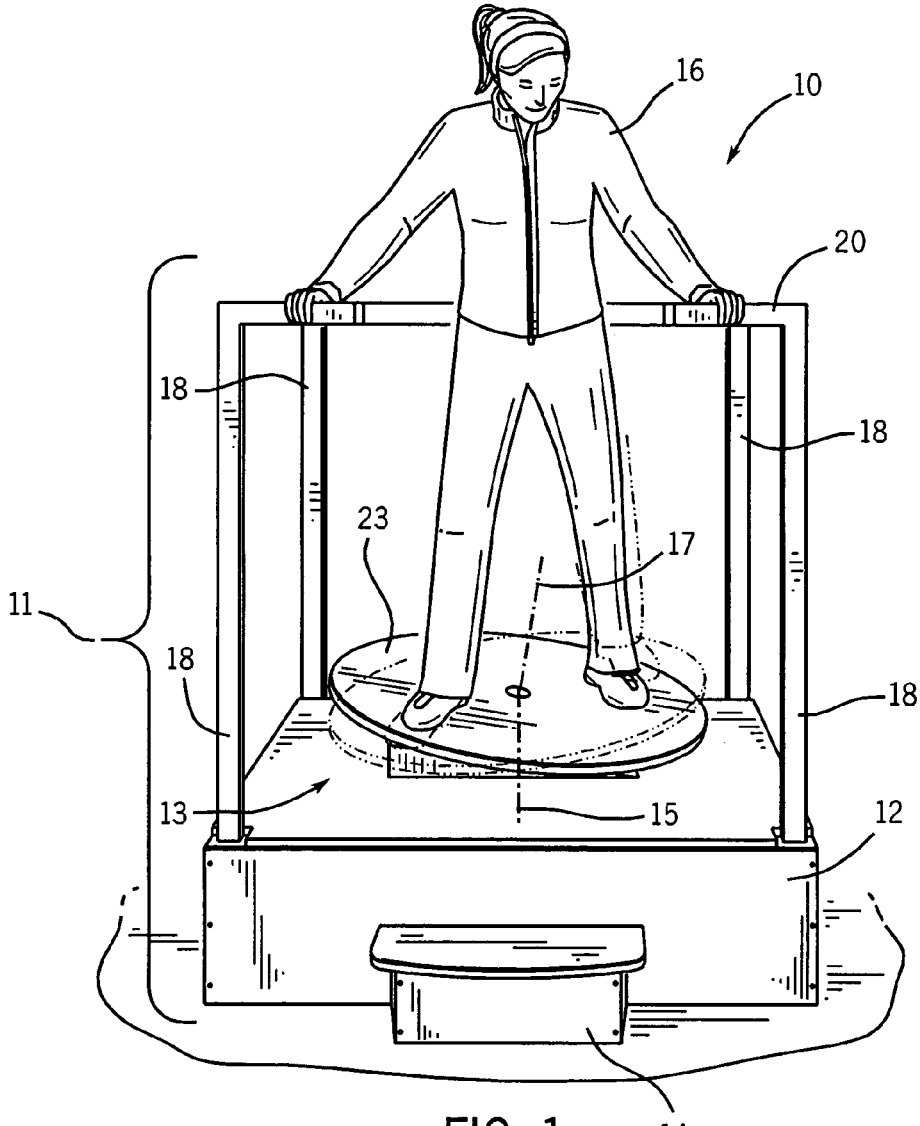
FIG. 1 is a front perspective view of an exercise device in accordance with the principles of the present invention.

Referring to FIG. 1, a front perspective view of an exercise device 10 in accordance with the principles of the present invention is seen. Initially, it should be understood that the use of the term exercise herein is meant it its broad sense a putting oneself into action or to tiring effort for the sake of developing and maintaining physical fitness, inclusive of both aerobic and anaerobic exercises and nontraditional exercises such as for example dance, physical therapy, etc. An exercise device 10 of the present invention includes a frame 11 and an oscillating assembly 13. The frame 11 can include a base 12 that supports and contains the oscillating assembly 13 described in detail, below. The base 12 can be configured for placement onto a surface. A step 14 can be provided adjacent to, or within, the base 12 to assist the user 16 onto the exercise device 10. In another alternative embodiment, the oscillating assembly can be recessed into, or repositioned about, the frame or base of the exercise device such that the user 16 does not have to climb a step or a raised base in order to access to step onto the oscillating platform. While a single adult user 16 is shown, the exercise device 10 is configured for use by one or more users of all ages and sizes. Further, the user can operate the exercise device in a variety of positions, standing, sitting, kneeling, etc.

Figure 2:
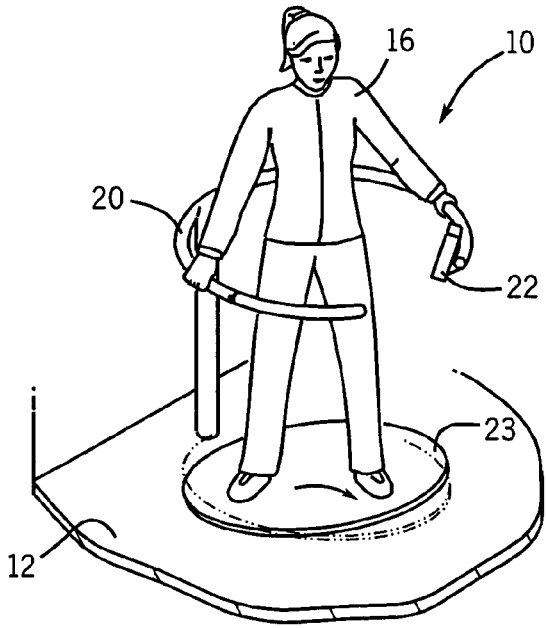
FIG. 2 is a perspective view of another embodiment of an exercise device in accordance with the principles of the present invention.
Figure 3:
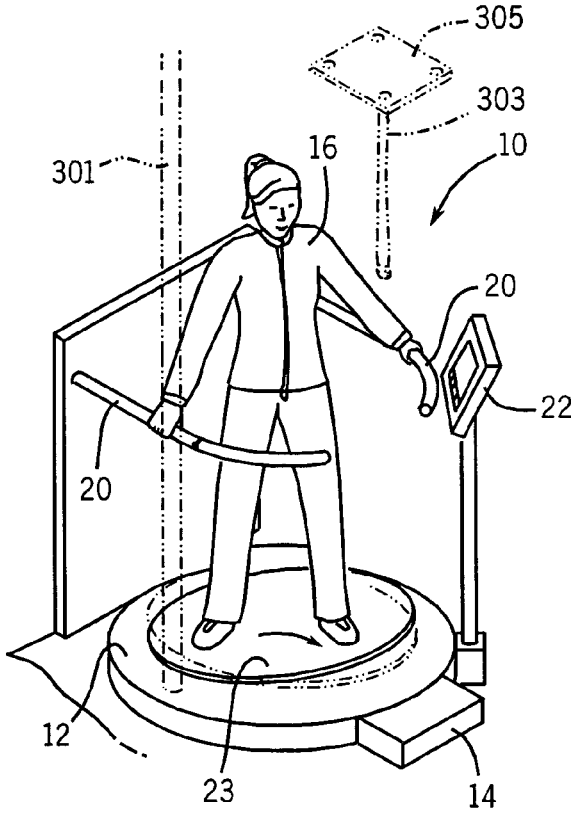
FIG. 3 is a perspective view of another embodiment of an exercise device in accordance with the principles of the present invention.

In one embodiment, the frame 11 can incorporate a plurality of posts 18 extending upwardly from the base 12. The posts 18 can support a handrail 20 that can be used by the user 16 for support. The handrail 20 may be in part or in whole covered by a gripping material or surface, such as tape, foamed synthetic rubber, etc. Referring to FIGS. 2 and 3, in alternative embodiments, alternative arrangements for providing support for the upper body of the user 16, in lieu of or in addition to a handrail 20 can be provided. In one alternative embodiment, a support pole 301 seen in phantom in FIG. 3 can be used. The support pole 301 can upwardly extend from base 12 or outwardly extend from other locations of frame. In alternative embodiments, the pole and post can be provided offset from the center axis of an oscillating platform 23 as seen in FIG. 3 or on the central axis of oscillating platform 23. In another alternative embodiment, one or more hanging supports such as a rope 303 hanging from a support 305 as shown in phantom in FIG. 3 can be provided. In other alternative embodiments, one or more upper body supports can downwardly or outwardly extend from the frame or other locations about the user, and the upper body supports can be pivotally and/or repositionably coupled to a support. In another embodiment, a handlebar assembly is coupled to the frame or the oscillating platform to provide upper body support to a user.

A user display panel 22 can be provided having information for the user 16 such as for example instructions for operating the device as well as control buttons and different exercise regiments. The display panel 22 can be connected to a controlling central processor unit (CPU). In some embodiments of the present invention, electronic devices may be incorporated into the exercise device 10 such as for example timers, odometers, speedometers, heart rate indicators, energy expenditure recorders, controllers, etc. This information may be routed to the display panel 22 for ease of viewing for the user 16.

Referring back to FIG. 1, the oscillating assembly 13 can be operatively positioned within the base 12 and can include an oscillating platform 23. The oscillating platform 23 can be a generally planar structure configured to support the weight of one or more users, preferably in an upright position. In one embodiment, the platform 23 has a circular shape. Alternatively, the platform 23 can be formed in other shapes, such as, for example, square, polygonal, oval and irregular. In other alternative embodiments, the platform can be formed in a non-planar configuration, such as for example in a generally concave or convex shape.

For purposes of this application, the term "oscillating" generally refers to an angular undulating cyclical motion produced when a user shifts his or her weight between different locations on the platform. In other words, "oscillating" refers to a generally rhythmic, generally cyclical motion of the platform with respect to a generally centrally positioned axis that forms a generally circular wavelike motion about the periphery of the platform. Further, the term "oscillating" can also relate to a generally circular wobbling or generally circular vacillating motion. The oscillating platform 23 can be dynamically supported by the exercise mechanics of the oscillating assembly 13 contained within the base 12 as described in detail below. The oscillating assembly 13 provides for a main axis 15 and a platform axis 17 extending at an angle from the main axis, as described in more detail, below.

Figure 4:
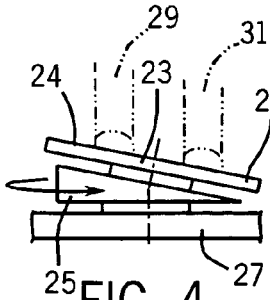
FIG. 4 is an elevated side schematic of the device of FIG. 1 in a first orientation.
Figure 5:
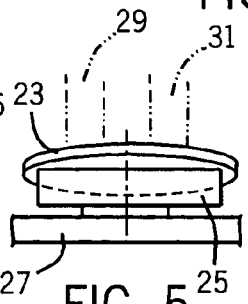
FIG. 5 is an elevated side schematic of the device of FIG. 1 in a second orientation.
Figure 6:
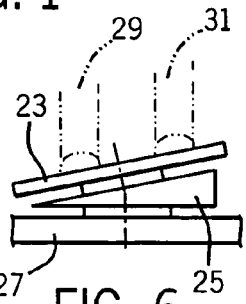
FIG. 6 is an elevated side schematic of the device of FIG. 1 in a third orientation.
Figure 7:
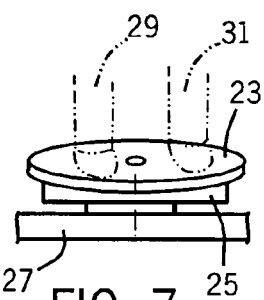
FIG. 7 is an elevated side schematic of the device of FIG. 1 in a fourth orientation
Figure 8:
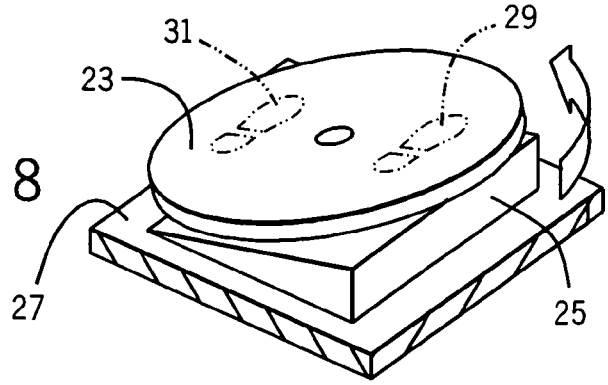
FIG. 8 is a perspective schematic of the device of FIG. 1 in the first orientation.
Figure 9:
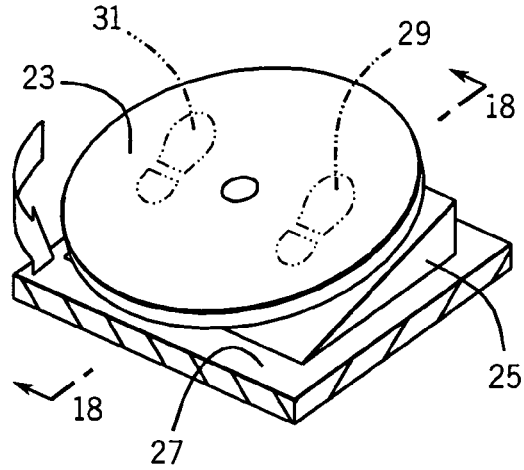
FIG. 9 is a perspective schematic of the device of FIG. 1 in the second orientation.
Figure 10:
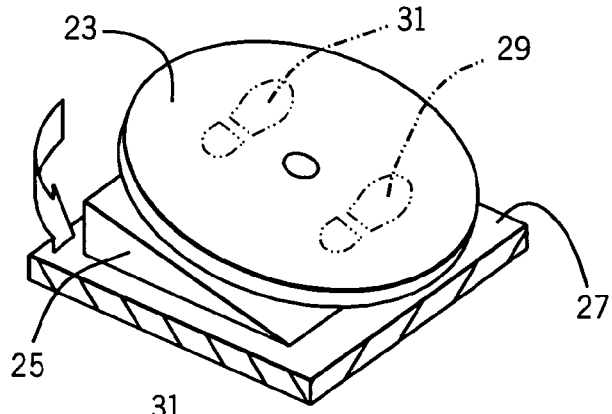
FIG. 10 is a perspective schematic of the device of FIG. 1 in the third orientation.
Figure 11:
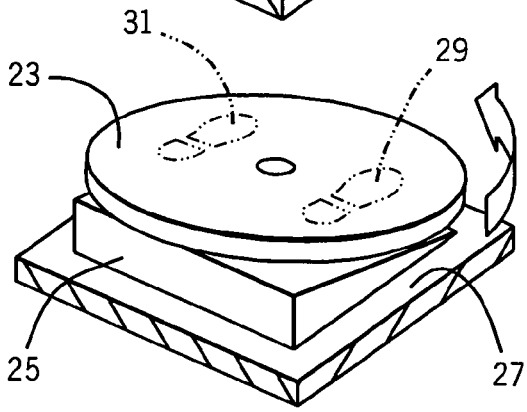
FIG. 11 is a perspective schematic of the device of FIG. 1 in the fourth orientation.

Referring now to FIGS. 4-11, the motion of the oscillating platform 23 is described. FIG. 4 is an elevated side schematic in a first orientation while FIG. 8 is a perspective view in that same orientation; FIG. 5 is an elevated side schematic in a second orientation while FIG. 9 is a perspective view in that same orientation; FIG. 6 is an elevated side schematic in a third orientation while FIG. 10 is a perspective view in that same orientation; and FIG. 7 is an elevated side schematic in a fourth orientation while FIG. 11 is a perspective view in that same orientation. It should be understood that the motion of the oscillating platform 23 is preferably fluid and continuous, and FIGS. 4-11 illustrate four discrete positions of the oscillating platform 23 in motion.

In one embodiment, as shown in FIGS. 4-11, the oscillating assembly 13 comprises a wedge 25 contained between the oscillating platform 23 and a support platform 27. The wedge 25 supports the oscillating platform 23 in a plane that is non-parallel to another plane defined by the support platform. While the motion of oscillating platform 23 in this embodiment is described with respect to use of the wedge 25 to support the oscillating platform 23, the use of other mechanisms are within the scope of the invention.

Referring to FIG. 4, because the oscillating platform 23 is angled with respect to the support platform, at any point in its motion, the platform 23 will include a raised portion 24 and a lowered portion 26. The raised portion 24 and the lowered portion 26 continuously change as the platform 23 proceeds through its motion.

To initiate movement the user 16, standing on the platform 23, shifts his or her weight onto the raised portion 24 of the platform 23. The additional weight placed on the raised portion 24 serves to squeeze or compress the raised portion of the wedge 25 between the oscillating platform 23 and the support platform 27. The weight draws the upper portion 24 of the oscillating platform 23 closer to the support platform, which tends to cause the wedge 25 to reposition or rotate away from this applied weight. As the wedge 25 rotates, it changes the angular orientation of the oscillating platform 23; for example, the user in FIGS. 4 and 8 places weight on her right leg 29, thus causing the wedge 25 to rotate to the position seen in FIGS. 5 and 9, thereby changing the angular orientation of the oscillating platform 23. Once the wedge 25 rotates and the oscillating platform 23 is in the angular position seen in FIGS. 5 and 9, the inertia or momentum of the wedge 25 combined with the user continuing to place weight on her right leg 29 will cause the wedge 25 to continue to rotate into the position seen in FIGS. 6 and 10, thereby continuing to change the angular orientation of the oscillating platform 23.

Once the wedge 25 rotates and the oscillating platform 23 is in the angular position seen in FIGS. 6 and 10, the inertia or momentum of the wedge 25 combined with the user alternating weight from the right leg 29 to the left leg 31 will cause the wedge 25 to continue to rotate into the position seen in FIGS. 7 and 11, thereby continuing to change the angular orientation of the oscillating platform 23. Once the wedge 25 rotates and the oscillating platform 23 is in the angular position seen in FIGS. 7 and 11, the inertia or momentum of the wedge 25 combined with the user continuing to place weight on the left leg 31 will cause the wedge 25 to continue to rotate into the position seen in FIGS. 4 and 8, thereby continuing to change the angular orientation of the oscillating platform 23 and starting the cycle again.

Figure 12:
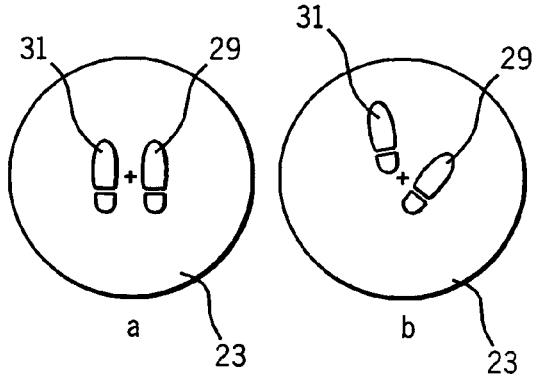
FIG. 12 is a perspective schematic of the device of FIG. 1 showing an alternative exercise position in accordance with the present invention.
Figure 13:
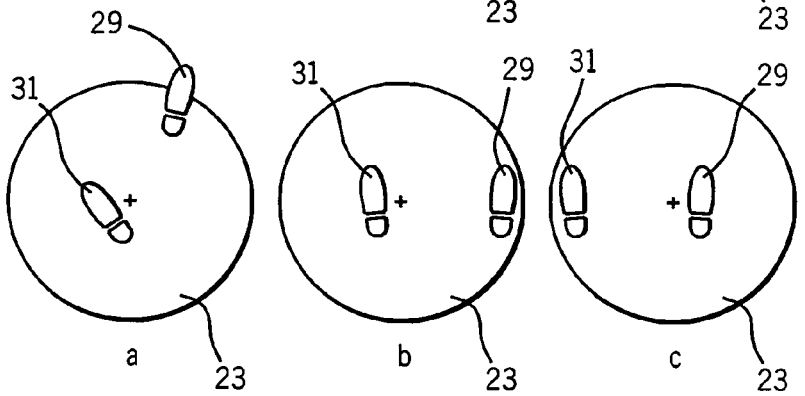
FIG. 13 is a perspective schematic of the device of FIG. 1 showing an alternative exercise position in accordance with the present invention.
Figure 14:
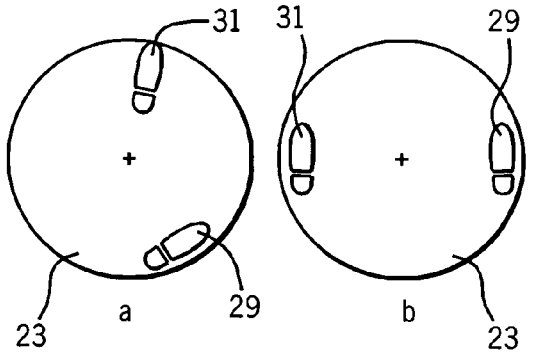
FIG. 14 is a perspective schematic of the device of FIG. 1 showing an alternative exercise position in accordance with the present invention.
Figure 15:
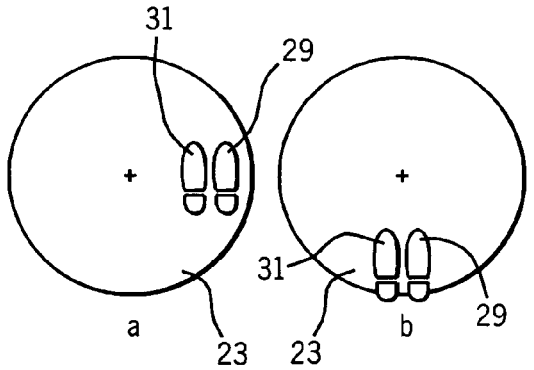
FIG. 15 is a perspective schematic of the device of FIG. 1 showing an alternative exercise position in accordance with the present invention.

While the placement of the user's feet in FIGS. 4-11 was used as example of an exercise position in explaining the motion of oscillating platform 23, the user can utilize a nearly infinite range of different exercise positions when using the device. Accordingly, the present exercise device enables a user to use his or her creativity to develop unique exercise routines, if so desired. Further, the present exercise device, enables a user to simulate dance routines, and other unique motions, if desired. FIGS. 12-15 are perspective schematics of the device of FIG. 1 showing just a few examples of the many alternative exercise positions contemplated under the present invention. While FIGS. 12-15 depict various examples of where a use can place her feet on the oscillating platform 23, it should be understood that a user can vary the motion of her exercise even within the same placement of her feet. As seen in FIG. 12*a*, the user can place her feet 29, 31 around the center of the oscillating platform 23, thus emphasizing heel and toe motion.

As seen in FIG. 12*b*, the user can place her feet 29, 31 around the center of the oscillating platform 23, with one foot 29 in a forward position and one foot 31 in an aft position, again emphasizing heel and toe motion. As seen in FIG. 13*a*, the user can place one foot 20 in the center aft position and one foot 31 near the outer periphery of the oscillating platform 23, thus placing emphasis on that leg. As seen in FIGS. 13*b* and 13*c*, the user can place one foot 31 in the center position and one foot 29 near the outer periphery of the oscillating platform 23, again placing emphasis on that leg. As seen in FIGS. 14*a* and 14*b*, the user can place both feet 29, 31 near the outer periphery of the oscillating platform 23, thus achieving maximum leverage, motion, and inertia. As seen in FIGS. 15*a* and 15*b*, the user can place both feet 29, 31 together near the outer periphery of the oscillating platform 23, thus replicating a jump or hop motion.

While FIGS. 8-15 show a plethora of alternative exercise positions, it should be appreciated that it is an advantage of an exercise device of the present invention that the user can utilize an almost endless range of exercise positions. In addition, because the user can be actively engaged in an active, dance-like movement and can utilize an almost endless variety of exercise positions, an exercise device of the present invention provides a more stimulating and enjoyable experience of exercising, which can be used to test and improve a user's stability, coordination, rhythm and/or balance.

Figure 16:
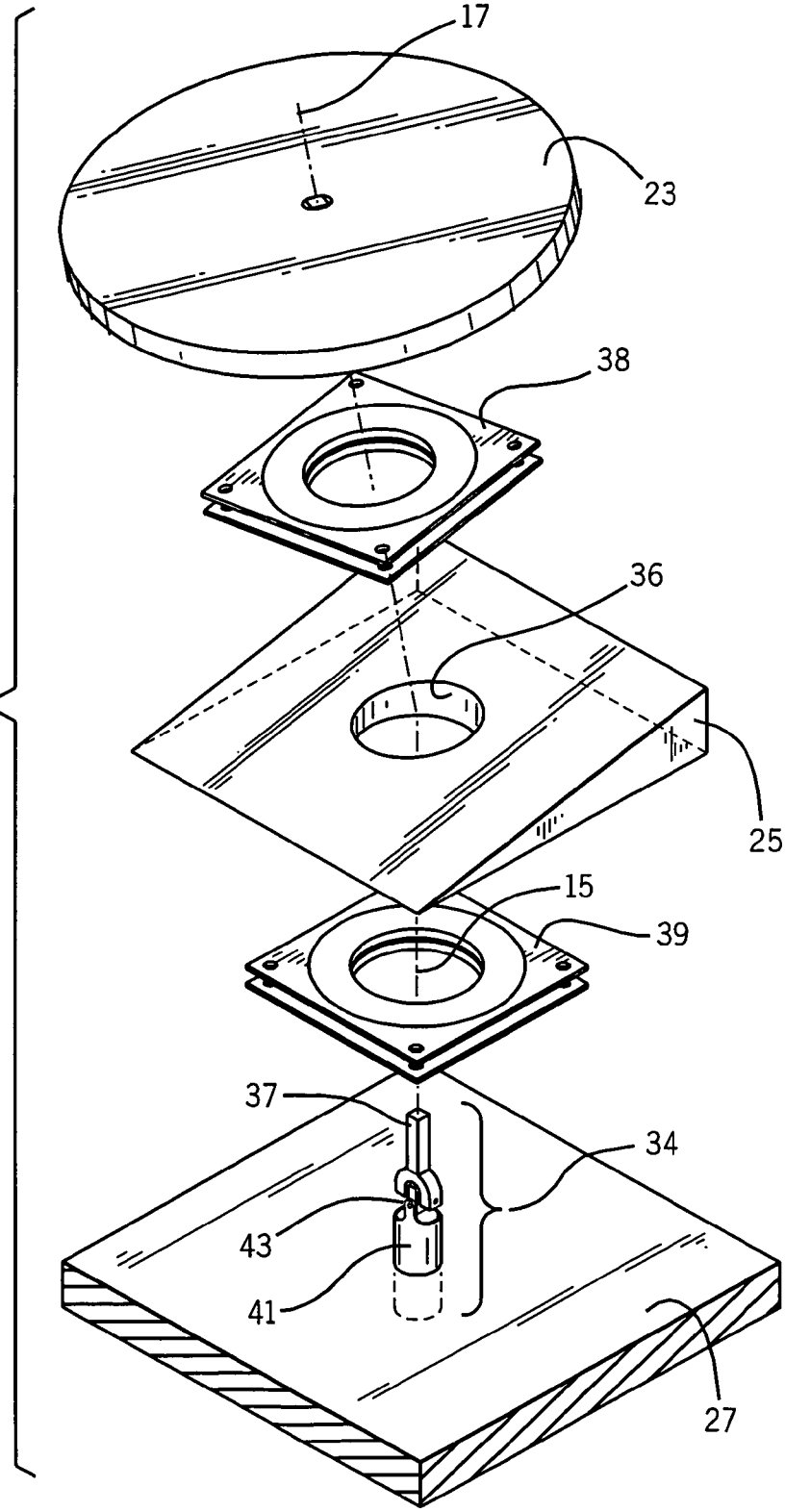
FIG. 16 is an exploded view of the device of FIGS. 4-11.
Figure 17:
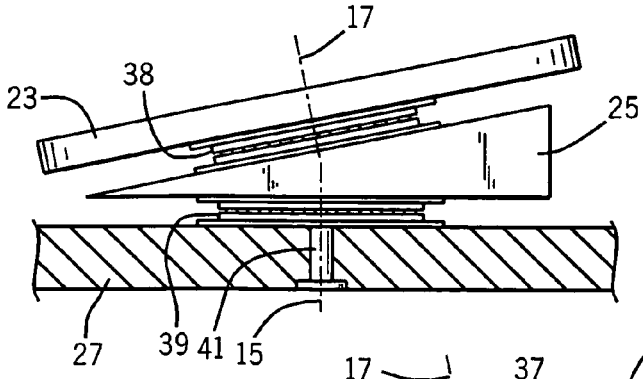
FIG. 17 is an elevated, partially cut-away side view of the device of FIG. 16.
Figure 18:
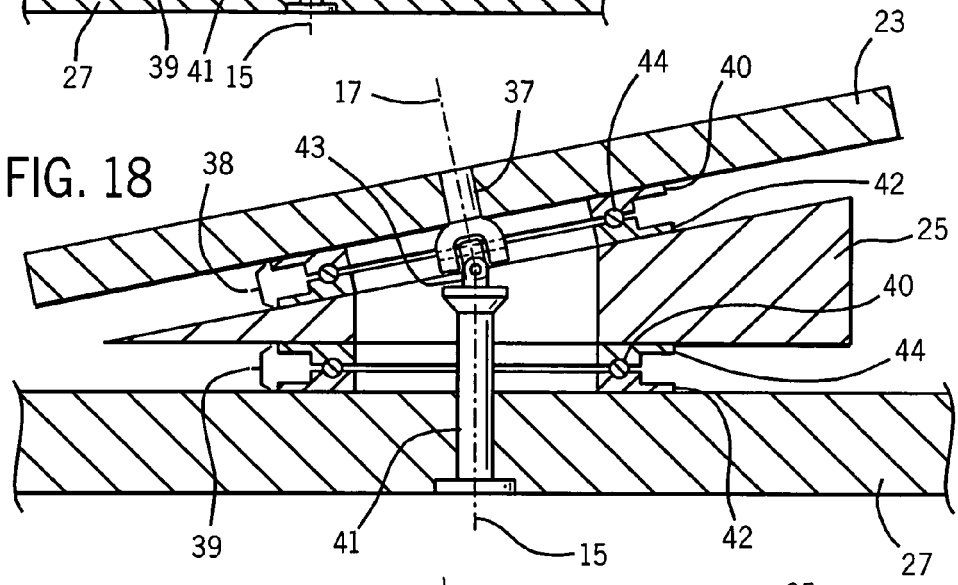
FIG. 18 is an elevated cut-away side view of the device of FIG. 16.

Referring to FIGS. 16-18, this embodiment of the oscillating assembly 13 is shown in greater detail, with FIG. 16 showing an exploded view of the device of FIGS. 4-11 and FIGS. 17 and 18 showing elevated, cut-away side views of the device of FIG. 16. The oscillating assembly 13 includes the oscillating platform 23, the support platform 27, the wedge 25, an oscillating platform stabilizer 34, and an anti-friction assembly, such as, for example, first and second bearing assemblies 38 and 39. The oscillating platform 23, the wedge 25, and the support platform 27 can each be preferably formed of a rigid durable material, such as a carbon-fiber composite material. Alternatively, the oscillating platform 23, the wedge 25 or the support platform 27 can be formed of other materials, such as, for example, aluminum, other composite materials, other thermoset materials, wood, steel, other metals, and combinations thereof. Further, the exercise device can be sized and constructed of materials that are sufficiently light in weight in a self-contained unit, that the exercise device can be readily transported from one location to another.

The support platform 27 engages the platform stabilizer 34 and provides a surface for supporting the second bearing assembly 39. The support platform 27 can be configured to resist the downward forces applied from the oscillating platform 23 during use, and therefore, enabling the downward forces to act upon the wedge 25 causing it to rotate with respect to the oscillating platform 23 and support platform 27. The support platform 27 can be separately, or integrally, formed with the base 12 (see FIG. 1). The support platform 27 can be any structure that properly supports the remaining components of the oscillating assembly.

Figure 19:
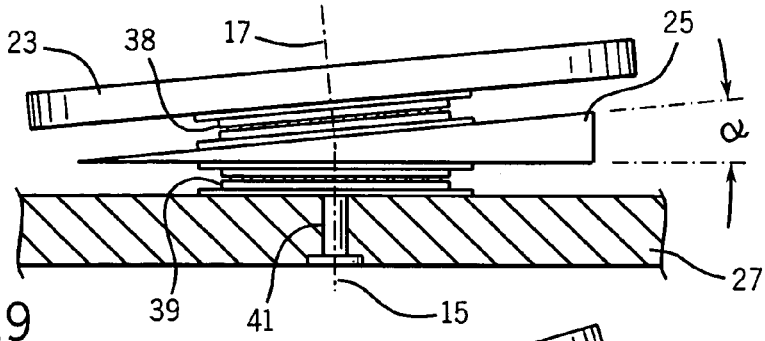
FIG. 19 is an elevated, partially cut-away side view of an additional embodiment of an exercise device in accordance with the principles of the present invention.

The wedge 25 can be rotatably engaged with the oscillating platform 23 and the support platform 27. The wedge 25 positions the oscillating platform 23 in a non-parallel plane with respect to the support platform, thereby creating an angle $\alpha$ between a plane extending through the oscillating platform 23 and a second plane. The second plane can be coincide with a plane defined by the support platform 27 or other support structure. The second plane can be a horizontal plane, or a non-horizontal plane. The wedge 25 can be positioned between the first bearing assembly 38 and the second bearing assembly 39 to allow for independent rotational movement of the wedge 25 with respect to the oscillating platform 23 and the support platform 27. Although FIGS. 17-19 illustrate the support platform 27 defining a generally horizontal plane and the oscillating platform 23 positioned at an angle $\alpha$ from the horizontal plane, other angular positions of the oscillating and support platforms are also contemplated. For example, the oscillating platform can be positioned along a generally horizontal plane and the support platform can be angled with respect to horizontal and the oscillating platform.

The material forming the wedge 25 preferably has a hardness sufficient to resist deformation under load during use, thereby maintaining the oscillating platform 23 at angle $\alpha$ as the wedge rotates during use. The material forming the wedge 25 can be selected for weight and density to provide an appropriate level of inertial force to the oscillating assembly 13. The wedge 25 defines an aperture 36 extending there through for receiving the platform stabilizer 34. In an alternative embodiment, the wedge can be substituted with any structure that creates an angle $\alpha$ between the oscillating platform 23 and a non-parallel plane. For example, one or more wheels or spheres positioned between the oscillating and support platforms at a radial distance from the main axis, and configured to revolve around the main axis, can be used in as a substitute for the wedge.

The oscillating platform stabilizer 34 can be a coupling member operably connecting the oscillating platform 23 and the support platform 27. The stabilizer 34 can include a first portion 37 preferably fixedly secured to, and downwardly extending from, the oscillating platform 23 along the platform axis 27, and a second portion 41 preferably fixedly secured to, and upwardly extending from, the support platform 27 along the main axis 15. The first portion 37 and the second portion 41 can be coupled to each other by a dual hinged support 43. The dual hinged support 43 allows for pivoting of the oscillating platform 23 with respect to the support platform 27 about two rotational axes, thereby providing for the angular undulating movement of the oscillating platform 23 with respect to the support platform 27. The platform stabilizer 34 extends from the support platform 27, through the second bearing assembly 39, through the aperture 36 defined in the wedge 25, and through the first bearing assembly 38, and is secured to the oscillating platform 23.

While the oscillating platform 23 is described with respect to use of a platform stabilizer 34 including the dual hinged support 43, the use of other mechanisms that enable the free angular undulating movement of the oscillating platform 23 are within the scope of the invention. In an alternative embodiment, the oscillating assembly 13 can be formed without a platform stabilizer provided that the wedge, or equivalent assembly, is sufficiently operably secured between the oscillating platform and the support platform 27.

The first bearing assembly 38 and the second bearing assembly 39, each can include an upper race 40 and a lower race 42 in which ride a plurality of ball bearings 44 (best seen in FIG. 18). Thus, the wedge 25 can rotate freely and independently from the support platform 27 and the oscillating platform 23. While the motion of oscillating platform 23 is described with respect to use of a bearing assembly as an anti-friction assembly, the use of other types of bearings and other mechanisms that enable the wedge to rotate independently from the support platform 27 and the oscillating platform 23 are within the scope of the invention.

Thus, in accordance with the principles of the present invention an exercise device is provided that comprises a platform that is supported in a non-parallel plane in relation to a support platform or other support structure. The platform can be connected to a support platform by a support having a main axis and a platform axis extending at an angle from the main axis. Free angular undulating movement of the platform is provided. Inertia or momentum of the angular movement of the platform is provided through the mass of the wedge (or equivalent structure) and the movement of the user, thereby providing a fluid and continuous change in the angular orientation of the platform.

Figure 20:
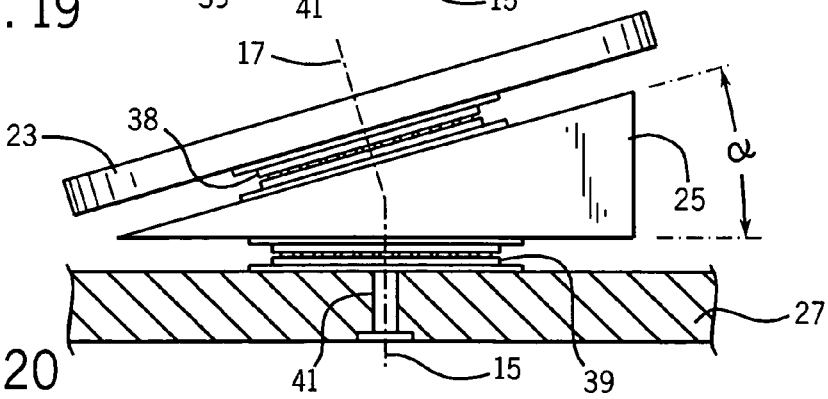
FIG. 20 is an elevated, partially cut-away side view of an additional embodiment of an exercise device in accordance with the principles of the present invention.
Figure 25:
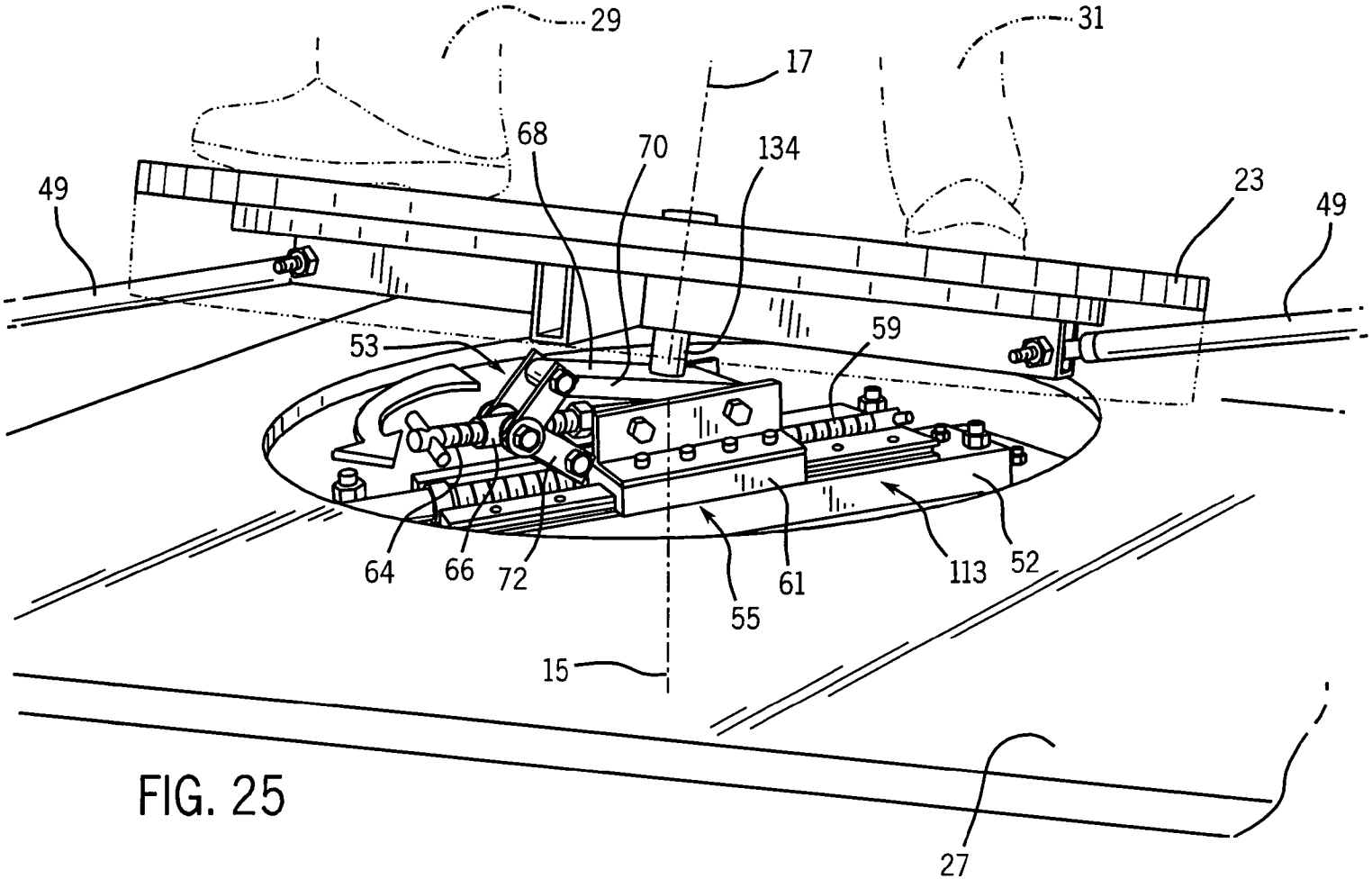
FIG. 25 is an elevated close-up view of an additional embodiment of an exercise device in accordance with the principles of the present invention.

Referring now to FIGS. 19 and 20, elevated, partially cut-away side views of the device of FIG. 16 in additional embodiments are seen. In the embodiment seen in FIG. 19, the angle $\alpha$ of the wedge 25 is relatively small while in the embodiment seen in FIG. 20, the angle $\alpha$ of the wedge is relatively large. An exercise device in accordance with the present invention having a relatively small angle $\alpha$ such as seen in FIG. 19 will provide the user with smoother motion and less movement, thus providing less strenuous exercise relative to an exercise device in accordance with the present invention having a relatively large angle $\alpha$ such as seen in FIG. 20.

In contrast, an exercise device in accordance with the present invention having a relatively large angle $\alpha$ such as seen in FIG. 20 will provide the user with a greater mechanical advantage thus providing a larger range of motion to the user relative to an exercise device in accordance with the present invention having a relatively small angle $\alpha$ such as seen in FIG. 19. The increased mechanical advantage of the larger angle $\alpha$ allows for the same or less effort to produce more movement. Thus, it is an advantage that an exercise device of the present invention can provide the user with a wide range of exercise levels. In additional embodiments described with respect to FIGS. 25-30 below, an exercise device in accordance with the present invention that allows for the angle of the oscillating platform 23 to be adjustable is described.

Referring now to FIGS. 21-24, additional embodiments of an exercise device 10 in accordance with the principles of the present invention are seen. While in the previously described embodiments, the oscillating platform 23 was oriented generally in the center of the wedge 25 on the same vertical main axis 15 as the support platform 27 and the platform stabilizer 34, in the embodiments of FIGS. 21-24 the oscillating platform 23 is oriented offset from the main vertical axis 15 of the support platform 27 and the upper portion of the platform stabilizer 34 off center of the wedge 25. In FIG. 21, the oscillating platform 23 is oriented offset from the vertical axis 15 of the support platform 27 and the platform stabilizer 34 off center on the outside or relatively thicker portion of the wedge 25. In FIG. 23, the oscillating platform 23 is oriented offset from the vertical axis of the support platform 27 and the platform stabilizer 34 off center on the inside or relatively thinner portion of the wedge 25.

Referring to FIG. 22, a schematic showing a movement simulated by the device of FIG. 19 is seen. Orienting the oscillating platform 23 on the outside or relatively thicker portion of the wedge 25 results in this more concave motion of the oscillating platform 23. Referring to FIG. 24, a schematic showing a movement simulated by the device of FIG. 23 is seen. Orienting the oscillating platform 23 on the inside or relatively thinner portion of the wedge 25 results in a more convex motion of the oscillating platform 23. Thus, it is an advantage that an exercise device in accordance with the present invention can provide the user with a wide range of motions. In additional embodiments described with respect to FIGS. 25-30 below, an exercise device in accordance with the present invention that allows for the centering or vertical orientation of the of the oscillating platform 23 to be adjustable is described.

Referring now to FIGS. 25-28, an additional embodiment of an exercise device in accordance with the principles of the present invention is seen. In this additional embodiment, the angle $\alpha$ between the oscillating platform 23 and the support platform 27 can be adjusted. In addition, in this additional embodiment, the vertical orientation, or the amount of offset, of the oscillating platform 23 relative to the support platform 27 can be adjusted. In alternative embodiments, the exercise device can be configured with either the angular adjustment feature or the offset adjustment feature. In another embodiment, the angle, and the amount of offset, between the oscillating platform and the support can be fixed at predetermined positions.

In this alternative embodiment, with the exception of the oscillating platform 23, the oscillating assembly 113 can be generally contained within the base 12 of the frame 11, or other form of housing. The oscillating assembly 113 includes the oscillating platform 23, the support platform 27, a pair of stabilizing arms 49, a shaft bearing assembly 134, an adjustable angular support mechanism 53, an adjustable offset support mechanism 55, and an inertial application mechanism 56. The support platform 27 can be configured to support the other components of the oscillating assembly 113. The stabilizing arms 49 are pivotable linkages configured to, operably support, and to inhibit rotational movement of the oscillating platform 23 with respect to the support platform 27, while allowing for the oscillating platform 23 to oscillate during use.

A first end of each of the stabilizing arms 49 can be pivotally coupled to the support platform 27 and a second end of each of the stabilizing arms can be pivotally coupled to the oscillating platform 23, preferably at opposing locations. Alternatively, the first end of the stabilizing arms 49 can be coupled to other locations on the frame of the exercise device. Each stabilizing arm 49 also preferably further includes an additional pivot point 50 to allow for generally free vertical movement of the second end of the arm. In alternative embodiments, the oscillating assembly can be configured with a single stabilizing arm, or equivalent structure. In additional alternative embodiments, the oscillating assembly can be configured without one or more stabilizing arms.

The shaft bearing assembly 134 includes an upper portion and a lower portion. The upper portion can be fixedly connected to the center of the oscillating platform 23 and to the adjustable angular support mechanism 53. The lower portion of the platform stabilizer 134 can be fixedly connected to the adjustable offset support mechanism 55 and rotatably coupled to the support platform 27. The shaft bearing assembly 134 in conjunction with the angular support mechanism 53 and the offset support mechanism 55 couples the oscillating and support platforms 23 and 27 in a manner that allows for the adjustment of the angle and the offset between the platforms. In alternative embodiments, one or both of the upper and lower portions of the shaft bearing assembly can be rotatably and/or pivotally coupled to the oscillating and support platforms, respectively.

The adjustable angular support mechanism 53 can be a linkage assembly that supports and places the oscillating platform 23 at an angle from the main axis. The angular support mechanism 53 can be connected between the upper portion of the shaft bearing assembly 134 and the offset support mechanism 55. In one embodiment, the angular support mechanism 53 includes a rotatable screw 64 rotatably engaged with a retaining socket 66 which can be attached to an accordion lift 68. The socket 66 can be configured to ride along the length of the screw 64 upon rotation of the screw 64. The accordion lift 68 can comprise a pair of linkage arms 70, 72 pivotally connected to the retaining socket 66 at a first end and to the offset support mechanism 55 at the other end. The upper portion of the shaft bearing assembly 134 can be securely coupled to one of the linkage arms 70 of the accordion lift 68.

Adjustment of the rotatable screw 64 repositions the retaining socket 66 thereby adjusting the distance between the socket 66 and the offset support mechanism 55. This change in distance changes the orientation of the accordion lift 68 thereby changing the angle of upper portion of the shaft bearing assembly 134 and the oscillating platform 23. Accordingly, to adjust the angle $\alpha$ between the oscillating platform 23 and horizontal, screw 64 can be rotated in one direction to cause the accordion lift 68 to increase angle $\alpha$, seen in FIG. 26. Concurrently, screw 64 can be rotated in the opposite direction to cause the accordion lift 68 to lower angle $\alpha$, seen in FIG. 27.

The adjustable angular support mechanism 53 of the oscillating assembly 113 can be positionable between at least a first position, wherein the oscillating platform 23 extends about a first plane defining a first angle, and a second position, wherein the oscillating platform 23 generally extends about a second plane defining a second angle. The second angle can be equal to, greater than or less than the first angle. In one embodiment, the adjustable angular support mechanism 53 can be configured to adjust angle $\alpha$ to any point within the range of zero degrees (0°) to forty-five degrees (45°). In another embodiment, the range of adjustment of angle $\alpha$ can be within three degrees (3°) to twenty degrees (20°). Other angular adjustment ranges are also contemplated and are included within the scope of this invention. The angular adjustment of the oscillating platform 23 can occur during use or while the exercise device is at rest.

In alternative embodiments, the rotatable screw 64 can be coupled to a motor, a rotary hand tool or other means to allow for remote adjustment of the screw. In additional alternative embodiments, other mechanisms can be used to accomplish the angular adjustment of the oscillating platform (change of angle $\alpha$) and are within the scope of this invention, such as, for example, a servomotor, or other mechanical/electrical actuators.

The adjustable offset support mechanism 55 can be a repositionable carriage assembly that supports the oscillating platform 23 and the adjustable angular support mechanism 53, through a range of available offset positions. The offset support mechanism 55 can be connected to the lower portion of the platform stabilizer 134 and to the angular support mechanism 53. In alternative embodiments, the offset support mechanism can directly connect the upper and lower portions of the platform stabilizer 134.

The offset support mechanism 55 can include a support body 52, an elongated threaded rod 59, and a carriage 61. The support body 52 can be a rigid member configured to support the rod 59 and the carriage 61. The lower portion of the platform stabilizer 134 can be rotatably coupled to the support body 52. The rod 59 and carriage 61 are operably coupled to the support body 52. The rod 59 can be threadedly engaged with the carriage 61 such that rotation of the rod 59 causes the carriage 61 to travel along the axial length of the rod 59. The rod 59 can include a head configured for manual operation or for connection with a drive unit, such as, for example, a hand tool or a motor. The accordion lift 68 and the upper portion of the platform stabilizer 134 can be coupled to the carriage 61, so that as the carriage 61 travels along the rod 59, in response to the rod's rotation, the upper portion of the platform stabilizer 134 and the adjustable angular support mechanism 53, including the accordion lift 68, also move with the carriage 61. Accordingly, the position of the oscillating platform 23 with respect to the lower portion of the platform stabilizer 134 and/or the support platform 27 can be adjusted as desired. Thus, through use of the adjustable offset support mechanism 55, the exercise device can be configured with no offset or any offset within the range of travel of the carriage 61.

Figure 26:
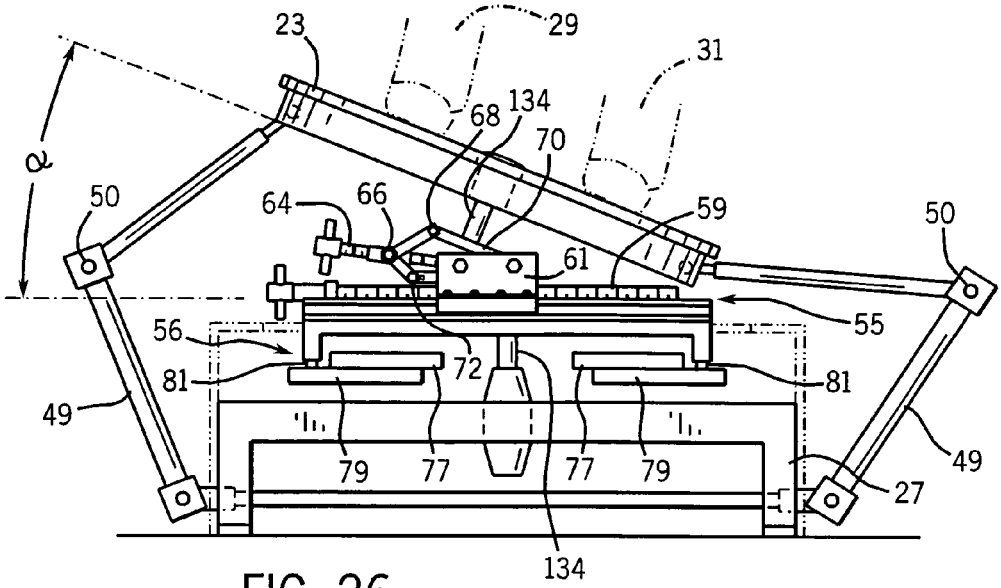
FIG. 26 is an elevated side view of the device of FIG. 25 in a first orientation.
Figure 27:
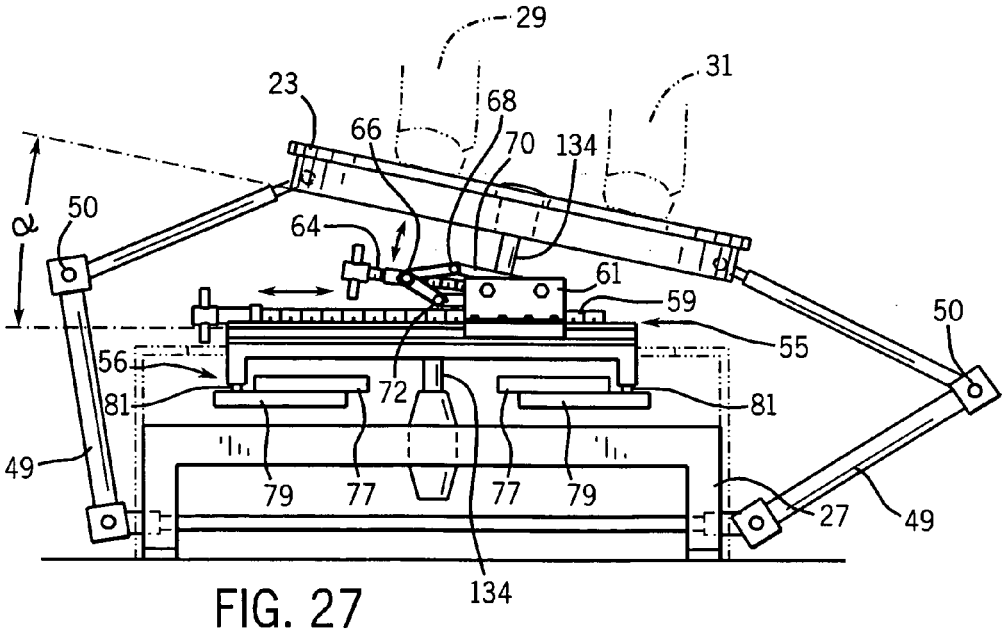
FIG. 27 is an elevated side view of the device of FIG. 25 in a second orientation.
Figure 28:
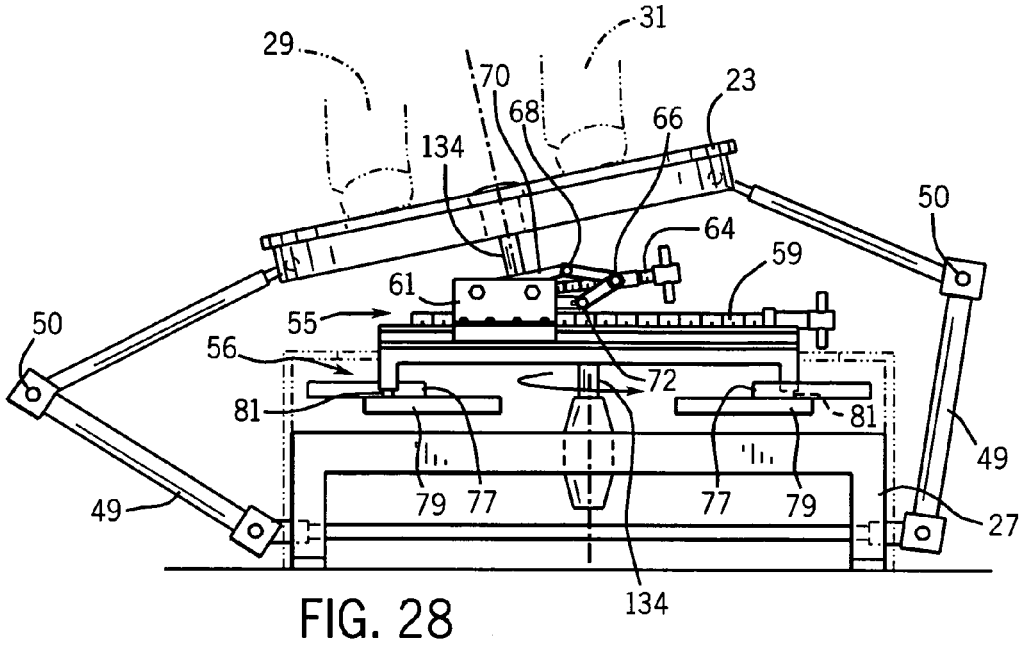
FIG. 28 is an elevated, partially cut-away side view of the device of FIG. 25 in a third orientation.

Further, to adjust the offset of the oscillating platform 23 relative to the support platform 27, screw 59 can be rotated in one direction which causes the retaining carriage 61 to move longitudinally thus orienting the oscillating platform 23 offset from the vertical axis (main axis 15) off center on the inside, as seen in FIG. 26. Concurrently, screw 59 can be rotated in the opposite direction to orient the oscillating platform 23 offset from the vertical axis (main axis 15) off center on the outside, as seen in FIG. 27. In alternative embodiments, the rod 59 can be directly coupled to a motor, or other means, to allow for remote adjustment of the rod. In additional alternative embodiments, other mechanisms can be used to accomplish the offset adjustment of the oscillating platform with respect to the main axis 15 and are within the scope of this invention, such as, for example, a pivotable linkage assembly, other gear drive assembly, or other mechanical or electrical motion control systems.

The adjustable offset support mechanism 55 of the oscillating assembly 113 can be positionable between at least a first position, wherein the platform can be generally centered about the main axis, and a second position, wherein the platform can be centered about a second axis parallel the main axis. The second axis can be positioned at a predetermined distance apart from the main axis within the adjustable range of the offset support mechanism 55. While various offset adjustment ranges are contemplated and are included within the scope of this invention, generally speaking in order to retain the center of gravity of the user at a safe level when the axes are offset, it is preferable for the intersection of the offset axes to occur in space above or below the platform (depending on the offset) at a distance that is less than the height of the hips of the user. In one embodiment, the offset support mechanism 55 can be configured to adjust the offset between the main axis and the second axis within the range of 0 to 2 feet. In another embodiment, the range of adjustment of offset adjustment can be within 0 to 3 inches. Other offset adjustment ranges are also contemplated and are included within the scope of this invention. The offset adjustment of the oscillating platform 23 with respect to the support platform 27 or the base 12 can occur during use or while the exercise device is at rest.

The inertial application mechanism 56 can be coupled to and extend from the support body 52 of the adjustable offset support mechanism 55. The inertial application mechanism 56 adds additional mass to the oscillating assembly 113, thereby increasing inertia. The inertial application mechanism 56 can include at least one shelf 79 and at least one weight 77 coupled to the shelf 79. The weight 77 and shelf 79 are functionally associated with the oscillating platform 23. In one embodiment, the inertial application mechanism 56 can include two separate shelves 79 and corresponding weights 77. Alternatively, three or more shelf and weight combinations can be used.

In one embodiment, each shelf 79 can be pivotally coupled to the support body 52 through a support shaft 81. The shelves 79 can include various positioning apparatus to enable the weights 77 to be placed at various radii from the center of the adjustable support housing 52 during use to vary the inertia. In one embodiment, the support shafts 81 can be spring-loaded such that, when at rest, the spring loaded support shaft 81 urges the shelf 79 and weight 77 closer toward the main axis 15 of the exercise device 10. During operation, as the rotational speed of the support body 52 increases, centrifugal force causes the weights 77 and shelves 79 to pivot outward away from the main axis 15, thereby increasing the inertia of the oscillating assembly 13 (as seen in FIG. 27). Upon reducing the operating speed of the exercise device, the weights 77 and shelves 79 begin to return to an at rest position closer to the main axis 15. In alternative embodiments the shelf and weights can be coupled to the oscillating assembly 13 through other means. In additional alternative embodiments, other forms of inertia adding mechanisms can be used such as for example a resistive fluid, one or more flywheels, one or more weighted rings, a generator, an eddy current system, etc.

In this embodiment, the wedge is replaced by the shaft bearing assembly and the adjustable angular support mechanism 53. In other alternative embodiments, other components can also be used in lieu of the wedge. The oscillating platform can be supported at an off-center location by one or more movable or rotatable supports, such as one or more wheels, rollers, sliders or equivalent devices. The movable or rotatable support can be configured to move in a predetermined path typically about or near the periphery of the oscillating platform. Such a movable or rotatable support places the oscillating platform at an angle with respect to: the ground, the frame of the exercise device, or a support platform while allowing the oscillating platform to move in an oscillating type motion when in use.

Figure 29:
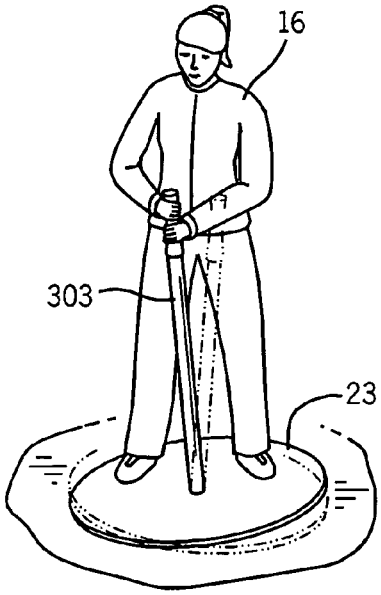
FIG. 29 is a perspective view of another embodiment of an exercise device in accordance with the principles of the present invention.
Figure 30:
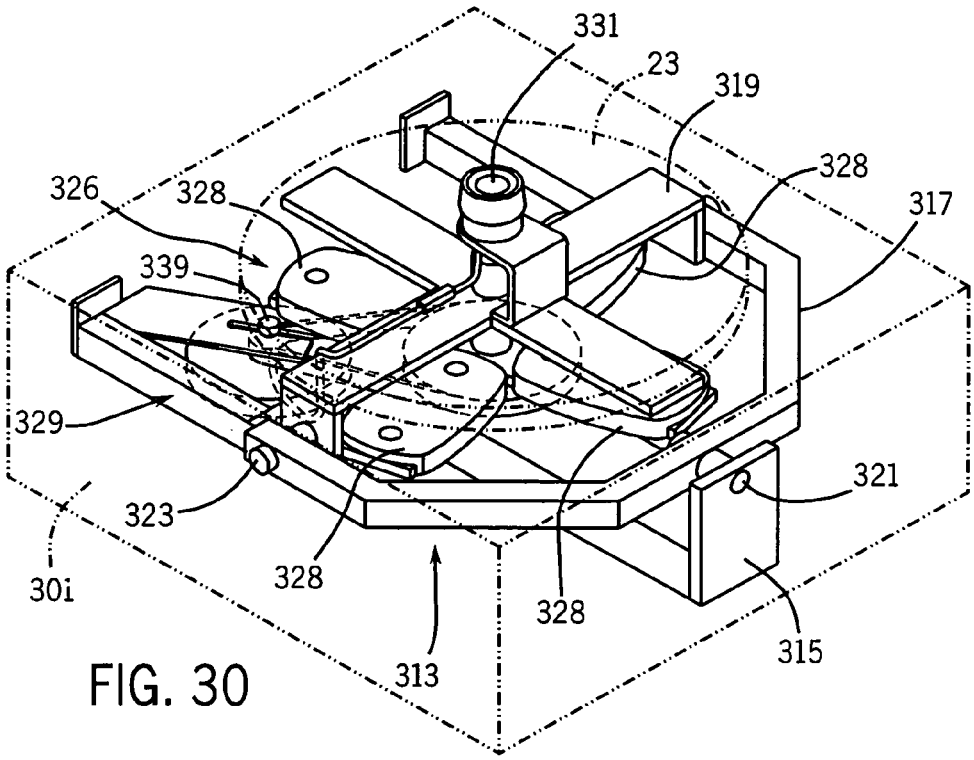
FIG. 30 is a close-up, perspective view of the exercise device of FIG. 29.
Figure 31:
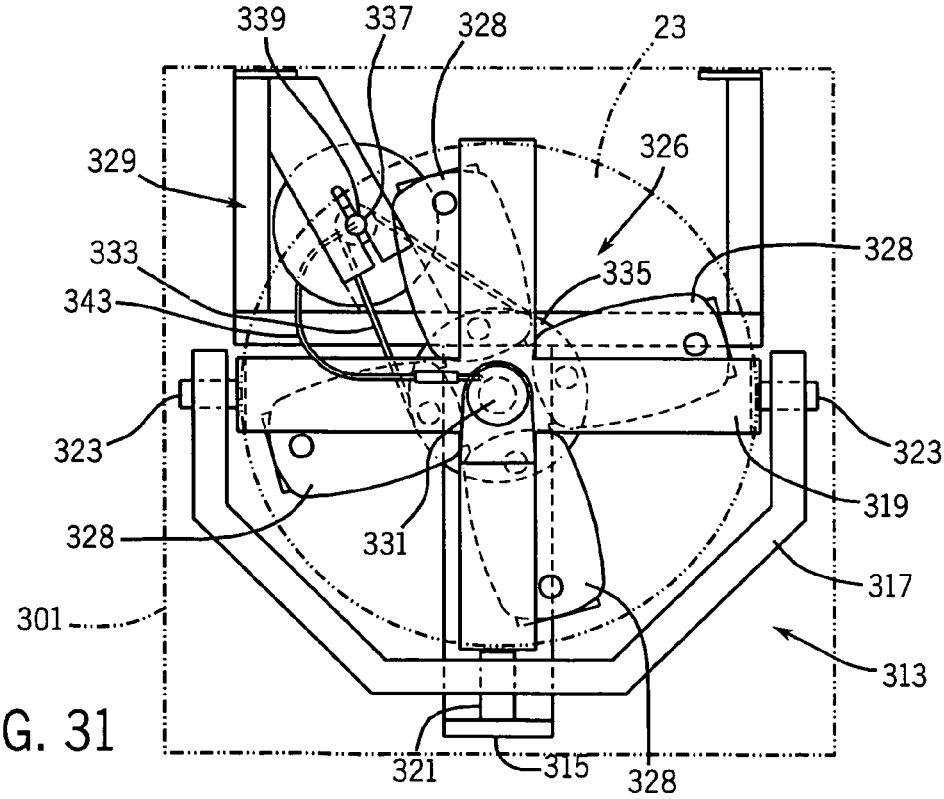
FIG. 31 is an overhead view of the exercise device of FIG. 29.

Referring to FIGS. 29-31, an additional embodiment of an exercise device in accordance with the principles of the present invention is seen. FIG. 29 is a perspective view showing a user 16 on this embodiment; FIG. 30 is a close-up, perspective view of the exercise device of FIG. 29; and FIG. 31 is an overhead view of the exercise device of FIG. 29. In this additional embodiment, the exercise device 10 can be made as a self-contained unit 301 and can be constructed of materials that are sufficiently lightweight so that the self-contained unit can be easily picked up and moved. As with the prior embodiment, the exercise device 10 includes an oscillating platform 23 (shown in phantom in FIGS. 30-31) that includes a main axis and a platform axis extending at an angle from the main axis. A support pole 303 can upwardly extend from the oscillating platform 23, as seen in FIG. 29, from the center or else wise. Alternatively, the exercise device can be formed without the support pole 303.

The exercise device 10 of the present invention can include an oscillating assembly 313. The oscillating assembly can include a first support 315 that can generally support the exercise device on the ground, a second support 317 that is pivotally connected at 321 to the first support 315, and a third support 319. The third support 319 is pivotally connected at 323 to the second support 317 preferably at a location perpendicular to the axis of the pivotal connection 321 between the first support 315 and the second support 317. Other non-perpendicular orientations can also be used. The third support 319 supports the oscillating platform 23. Thus, first support 315, second support 317 and third support 319 acting in conjunction with pivot 321 and pivot 323 to impart the generally steady, rhythmic, angular undulating cyclical motion of the oscillating platform 23 with respect to a central axis when a user shifts his or her weight between different locations on the platform that forms a circular wavelike motion about the periphery of the platform which, for the purposes of this application, is referred to as "oscillating".

The exercise device 10 of the present invention can include an inertial application mechanism 326. The inertial application mechanism 56 can include at least one weight 328 functionally associated with the oscillating platform 23. The inertial application mechanism 326 adds additional mass to the oscillating assembly 313, thereby increasing inertia and providing a fluid and continuous change in the angular orientation of the oscillating platform 23.

The exercise device 10 of the present invention can include a user variable resistance mechanism 329, such as for example a generator, or a brake system including an eddy current brake assembly, for selectively applying a braking or retarding force on the motion of the oscillating platform 23. A step-up pulley 335 can be provided which drives a smaller driven sheave 337 via a belt 333. The driven sheave 337 can be mounted on a rotatable stub shaft 339. A load applicator 342 be provided, such as, for example, an eddy current brake assembly. The eddy current brake assembly can include a solid metallic disk mounted on the stub shaft 339 inboard of driven sheave 337 to also rotate with the driven sheave 337. An annular faceplate of highly electrically conductive material, e.g., copper, can be mounted on the face of the solid disk. A pair of magnet assemblies can be mounted closely adjacent the face of the solid disk opposite the annular plate. The magnet assemblies each include a central core in the form of a bar magnet surrounded by a coil assembly. The magnet assemblies can be positioned along the outer perimeter portion of the disk in alignment with the annular plate. The location of the magnet assemblies may be adjusted relative to the adjacent face of the disk so as to be positioned as closely as possible to the disk without actually touching or interfering with the rotation of the disk.

The difference in size between the diameters of step-up pulley 335 and driven sheave 337 results in a step up in rotational speed of the disk relative to the motion of the oscillating assembly 13. The rotational speed of the disk is thereby sufficient to produce relatively high levels of braking torque through the eddy current brake assembly. A user control dial 331 can be provided (best seen in FIG. 30). The user control dial 331 can vary the resistance of the user variable resistance mechanism by mechanical connection such as for example a wire 343. In another embodiment, a CPU can be provided and the resistance can be transmitted to a CPU through an analog to digital interface and controller. In alternative embodiments, other forms of resistance mechanisms can or load applicators can be used, such as, for example, an air fan, a fluid brake, a flywheel, a magneto brake or other conventional resistance applicator.

The exercise device 10 of the present invention can include a clocking system that can allow the oscillating platform 23 to rotate relative to the support platform 27 by a pre-determined amount during use. Thus, in one embodiment in addition to or instead of providing resistance, the user variable resistance mechanism 329 can comprise a motor or other drive unit that can be used to clock the oscillating platform 23. In another embodiment, referring to FIG. 18, a clocking system can be applied to the upper race 40 or the lower race 42 or both to allow the oscillating platform 23 to rotate relative to the support platform 27. In other embodiments, the clocking of the oscillating platform can be performed through a gear assembly, or any combination of belts, pulleys, chains, actuators, and conventional drive components.

The amount, speed or rate of rotation of the oscillating platform 23 with respect to the support platform 27 or other support structure, can be fixed, variable, pre-programmed or manually adjustable by the user. In one embodiment, the predetermined rate of rotation of the oscillating platform can be within the range of one twentieth of a degree (0.05°) per second to ninety degrees (90°) per second. In a further embodiment, the predetermined rate of rotation of the oscillating platform can be within the range of one tenth of a degree (0.1°) per second to twelve degrees (12°) per second. In another preferred embodiment, the predetermined rate of rotation of the oscillating platform can be within the range of two tenths of a degree (0.2°) per second to six degrees (6°) per second. The speed or rate of rotation of the oscillating platform 23 can also be used as a means for timing a portion, or all, of the user's workout session on the exercise device 10. For example, if the speed or rate of rotation is set at one degree (1°) per second, the oscillating platform would complete a 360 degree revolution in six minutes. Therefore, if the user desired to exercise on the exercise device for 30 minutes than the user could time his or her exercise session based upon the number of platform rotations, which in this example would be five complete rotations of the oscillating platform.

In an additional embodiment, the clocking movement can be driven by a gear assembly that causes the platform stabilizer or shaft of the oscillating platform to rotate at a predetermined rate as the exercise device is in use. In an additional embodiment, the rotation of the oscillating assembly can be geared down to cause a rotation of the oscillating platform at a predetermined rate. In an additional embodiment, a resistance mechanism can be provided that would inhibit rotation of the oscillating platform; as the user applied more force to the platform during use, the exercise device can be configured such that the force causes a rotation of the disc. In other words, the speed or rate of rotation of the platform can be related to the amount of force the user is exerting on the platform, or the user's stroke or stride length. In an additional embodiment, the entire structure could be elevated placing it upon an additional base and a pivotal support shaft extending from beneath the device into the bottom of the exercise device. The support shaft then can be configured to be rotated thereby rotating either the entire exercise device or just the oscillating platform.

It may be desirable to monitor the rate of motion of the oscillating platform and/or the oscillating assembly so as to measure the level of exertion by the user of the present device and also to control the level of exercise experienced by the user. The rate of the oscillating platform can be transmitted to the CPU through an analog to digital interface and controller and user information can be provided to the display panel 22.

Figure 32:
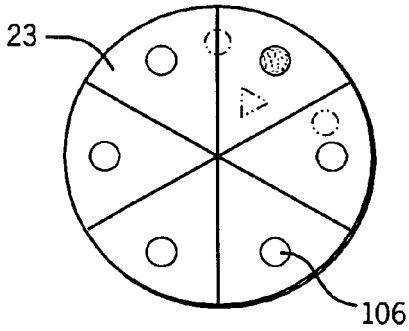
FIG. 32 is an overhead view of an oscillating platform of another embodiment of an exercise device in accordance with the principles of the present invention.

Referring to FIG. 32, in additional embodiments in accordance with the principles of the present invention, stimuli can be provided in the oscillating platform 23 to assist or direct the user's exercise. For example, a plurality of platform lights 106 of various shapes and colors could be provided in the oscillating platform 23 that light up to direct the placement of the feet of a user. Further, auditory sounds could be provided connected to sensors in the oscillating platform 23 to inform the user whether the light directed movements were successfully executed. Various exercise regiments could be programmed into the CPU to direct the operation of the platform lights and/or the auditory sounds in conjunction with the display control panel 22 or the motion of the user.

While the invention has been described with specific embodiments, other alternatives, modifications and variations will be apparent to those skilled in the art. Accordingly, it will be intended to include all such alternatives, modifications and variations set forth within the spirit and scope of the appended claims.

What is claimed is:

1. An exercise device comprising:

a base having a main axis;

a movable unit supported by the base;

a platform operably coupled to the movable unit, the platform defining a second axis that is non-parallel to the main axis, the movable unit rotatable about at least one of the main axis and the second axis, the platform configured to support a user;

an upper body support coupled to at least one of the base and the platform; and a stabilizer operably coupling the platform to the base, the stabilizer allowing free angular movement of the platform while the platform remains rotatably fixed relative to a support platform, wherein the movable unit is configured to rotate relative to the base solely in response to repositioning of a user's feet upon the platform; and a variable resistance mechanism operably coupled to the movable unit, and wherein the variable resistance mechanism is selected from the group consisting of a generator, an air fan and combinations thereof.

2. The exercise device of claim 1, wherein the upper body support is selected from the group consisting of: an upwardly extending pole, a hand rail, a handlebar, a rope, a suspended handle, and combinations thereof.

3. The exercise device of claim 1 further wherein the movable unit comprises a wedge contained between the platform and the base, the wedge rotating independently from the platform and the base.

4. The exercise device of claim 3 further wherein the wedge is engaged with the platform by an anti-frictional assembly and the wedge is engaged to the base by an anti-friction assembly.

5. The exercise device of claim 3 further wherein the wedge provides movement inertia.

6. The exercise device of claim 1, wherein the movable unit contributes to the non-parallel alignment of the second axis and the main axis.

7. The exercise device of claim 6, wherein the movable unit is positioned to support the platform at an off-center location.

8. The exercise device of claim 7, wherein the movable unit comprises at least one of a wheel, a roller, a slider and combinations thereof.

9. The exercise device of claim 1, wherein the base comprises a first support configured to generally support the movable unit and the platform, and the exercise device further including a second support, which is pivotally connected to the first support, and a third support pivotally connected to the second support at a location angularly spaced from the pivotal connection between the first support and the second support.

10. The exercise device of claim 1 further wherein the stabilizer comprises a double-hinged support extending generally upwardly from and mounted in the base and connected to the platform.

11. The exercise device of claim 1, wherein the exercise device can be constructed of materials that are sufficiently lightweight so that the self contained unit can be easily picked up and moved.

12. The exercise device of claim 1, wherein the platform has a shape selected from the group consisting of planar, concave, convex, dished, conical and combinations thereof.

13. The exercise device of claim 1 further comprising an adjustable unit, wherein the adjustable unit and the movable unit form an intermediate assembly supported by the base and wherein the adjustable unit is positionable between at least a first position, wherein the platform generally extends about a first plane defining a first angle with respect to the base, and a second position, wherein the platform generally extends about a second plane defining a second angle with respect to the base, the second angle being greater than the first angle.

14. The exercise device of claim 13, wherein rotation of the movable unit is independent of the platform and the base, and wherein the rotation of the movable unit adds inertia to the movement of the exercise device.

15. The exercise device of claim 13 further wherein vertical orientation of the platform is positioned off center.

16. The exercise device of claim 13, wherein the first and second angles are selected within the range of 0 to 45 degrees.

17. The exercise device of claim 13, wherein the first and second angles are selected within the range of 3 to 20 degrees.

18. The exercise device of claim 13, wherein the platform has a shape selected from the group consisting of planar, concave, convex, dished, conical and combinations thereof.

19. The exercise device of claim 13, further comprising a variable resistance mechanism operably coupled to the intermediate assembly, and wherein the variable resistance mechanism is selected from the group consisting of a generator, a brake assembly, an air fan and combinations thereof.

20. The exercise device of claim 1 further comprising an adjustable unit, wherein the adjustable unit and the movable unit form an intermediate assembly operably coupled to the platform, wherein the adjustable unit of the intermediate assembly is positionable between at least a first position, wherein the platform is generally positioned about the main axis, and a second position, wherein the platform is generally positioned about a second axis parallel the main axis, the second axis being a first predetermined distance apart from the main axis.

21. The exercise device of claim 20, wherein the base comprises a first support configured to generally support the intermediate assembly and the platform, and the exercise device further including a second support, which is pivotally connected to the first support, and a third support pivotally connected to the second support at a location angularly spaced from the pivotal connection between the first support and the second support.

22. The exercise device of claim 20, wherein the first predetermined distance is selected from the range of 0 inches to 2 feet.

23. The exercise device of claim 20, wherein the first predetermined distance is selected from the range of 0 to 3 inches.

24. The exercise device of claim 1 further comprising an inertial application assembly coupled to the movable unit, the inertial application assembly configured to vary the inertia of the exercise device during use.

25. An exercise device comprising:

a base having a main axis;

a movable unit supported by the base;

a platform operably coupled to the movable unit, the platform defining a second axis that is non-parallel to the main axis, the movable unit rotatable about at least one of the main axis and the second axis, the platform configured to support a user; and an upper body support coupled to at least one of the base and the platform, wherein the base comprises a first support configured to generally support the movable unit and the platform, and the exercise device further including a second support, which is pivotally connected to the first support, and a third support pivotally connected to the second support at a location angularly spaced from the pivotal connection between the first support and the second support.

26. An exercise device comprising:

a base having a main axis;

a movable unit supported by the base;

a platform operably coupled to the movable unit, the platform defining a second axis that is non-parallel to the main axis, the movable unit rotatable about at least one of the main axis and the second axis, the platform configured to support a user;

an upper body support coupled to at least one of the base and the platform; and a stabilizer operably coupling the platform to the base, the stabilizer allowing free angular movement of the platform while the platform remains rotatably fixed relative to a support platform; and a variable resistance mechanism operably coupled to the movable unit, and wherein the variable resistance mechanism is selected from the group consisting of a generator, an air fan and combinations thereof.

* * * * *